US011685640B2

(12) United States Patent
Cortesi

(10) Patent No.: US 11,685,640 B2
(45) Date of Patent: Jun. 27, 2023

(54) FILLING MACHINE CONFIGURED TO FILL CONTAINERS WITH A POURABLE PRODUCT AND METHOD

(71) Applicant: SIDEL PARTICIPATIONS, Octeville-sur-Mer (FR)

(72) Inventor: Andrea Cortesi, Parma (IT)

(73) Assignee: SIDEL PARTICIPATIONS, Octeville-sur-mer (FR)

( * ) Notice: Subject to any disclaimer, the term of this patent is extended or adjusted under 35 U.S.C. 154(b) by 0 days.

(21) Appl. No.: 17/704,904

(22) Filed: Mar. 25, 2022

(65) Prior Publication Data

US 2022/0315406 A1 Oct. 6, 2022

(30) Foreign Application Priority Data

Apr. 2, 2021 (EP) ..... 21166809

(51) Int. Cl.
*B67C 7/00* (2006.01)
*B67C 3/28* (2006.01)

(52) U.S. Cl.
CPC ..... *B67C 7/0046* (2013.01); *B67C 3/287* (2013.01); *B67C 7/0013* (2013.01)

(58) Field of Classification Search
CPC ..... B67C 3/007
USPC ..... 141/129
See application file for complete search history.

(56) References Cited

U.S. PATENT DOCUMENTS

2007/0107801 A1* 5/2007 Cochran ..... B67C 3/007 141/153
2020/0189898 A1 6/2020 Theopold et al.

FOREIGN PATENT DOCUMENTS

DE 4306120 C1 7/1994
EP 2460761 A1 6/2012

OTHER PUBLICATIONS

European Search Report dated Sep. 13, 2021.

* cited by examiner

*Primary Examiner* — Timothy P. Kelly
*Assistant Examiner* — Christopher M Afful

(57) ABSTRACT

A filling machine configured to fill containers with a pourable product having a conveyor configured to receive containers to be filled at an input station, and a plurality of filling devices carried by the conveyor and each configured to fill one container at a time with a predetermined amount of pourable product during its advancement along the filling path. Each filling device includes a filling valve controllable between an open position and a closed position. The machine also includes a control unit configured to generate a signal for triggering the opening of the filling valves and to sequentially send said signal to each filling device. Each filling device is configured to receive one container at a time at the input station, and the control unit is configured to send the signal to each filling device with an advance time before the filling device receives the container to be filled.

18 Claims, 3 Drawing Sheets

FILLING MACHINE CONFIGURED TO FILL CONTAINERS WITH A POURABLE PRODUCT AND METHOD

TECHNICAL FIELD

The present invention relates to a filling machine, in particular a filling machine of the non-contact type, configured to fill containers with a pourable product, preferably a pourable food product.

The present invention further relates to a method for filling containers, in particular for filling them in a non-contact mode, with a pourable product, preferably a pourable food product.

BACKGROUND

Filling machines are known which are configured to fill containers, for example bottles, made of plastic or glass, cans, jars, pots, or the like, with a pourable product, preferably a pourable food product such as water, wine, juice, yogurt, honey, milk, beer, soft drinks, vegetables to be canned like peas or beans, powders like sugar, grind coffee or salt, or the like.

Such filling machines typically include a conveyor, generally of the rotary type, usually in the form of a carousel rotatable about a vertical axis, a reservoir containing the pourable product, and a plurality of filling devices peripherally carried by the carousel, connected to the reservoir by means of respective circuits or ducts (and through a manifold) and conveyed by the carousel itself along an arc-shaped filling path.

More precisely, the containers to be filled are fed in use to the carousel at an input station thereof, usually by means of an inlet star wheel, then are conveyed along the arc-shaped filling path, which defines a filling angle with respect to the carousel axis, so as to be filled with the pourable product by respective filling devices, and then exit the carousel at an output station thereof, usually by means of an outlet star wheel.

Hence, the input station defines the start point of the filling angle (and of the filling path) and the output station defines the end point of the filling angle (and therefore of the filling path).

Each filling device usually includes:

- a filling valve configured to feed a predetermined volume of pourable product to the respective container, while the filling device moves along the filling path due to the rotary movement imparted by the carousel; and
- a support element adapted to receive and hold in a vertical position, below the valve itself, one respective container.

In filling valves of the non-contact type, the axial outlet opening of the tubular body is spaced from the end opening of the respective container to be filled during filling.

Although being functionally valid, the filling machines of the above-mentioned type are still open to further improvement.

In particular, it is known that the filling valves operate with an intrinsic delay due to the unavoidable inertia of their mechanical components. Furthermore, a part of such delay is also due to the power for controlling such valves, for example pneumatic power in the case of pneumatic valves.

These effects can lead, especially after long usage or in determined conditions, to a relatively long opening transient of the filling valves. This often results in product spillage, especially in the case of non-contact filling valves, and in a reduction of the nominal filling angle, which can have undesired effects on the expected production volume.

SUMMARY OF INVENTION

It is therefore an object of the present invention to provide a filling machine which is designed to overcome at least one of the above-mentioned drawbacks in a straightforward and low-cost manner.

This object is achieved by a filling machine as claimed.

It is a further object of the present invention to provide a method for filling containers with a pourable product which is designed to overcome at least one of the above-mentioned drawbacks in a straightforward and low-cost manner.

This object is achieved by a method for filling containers.

BRIEF DESCRIPTION OF THE DRAWINGS

A non-limiting embodiment of the present invention will be described by way of example with reference to the accompanying drawings, in which.

DETAILED DESCRIPTION

Figure 1:
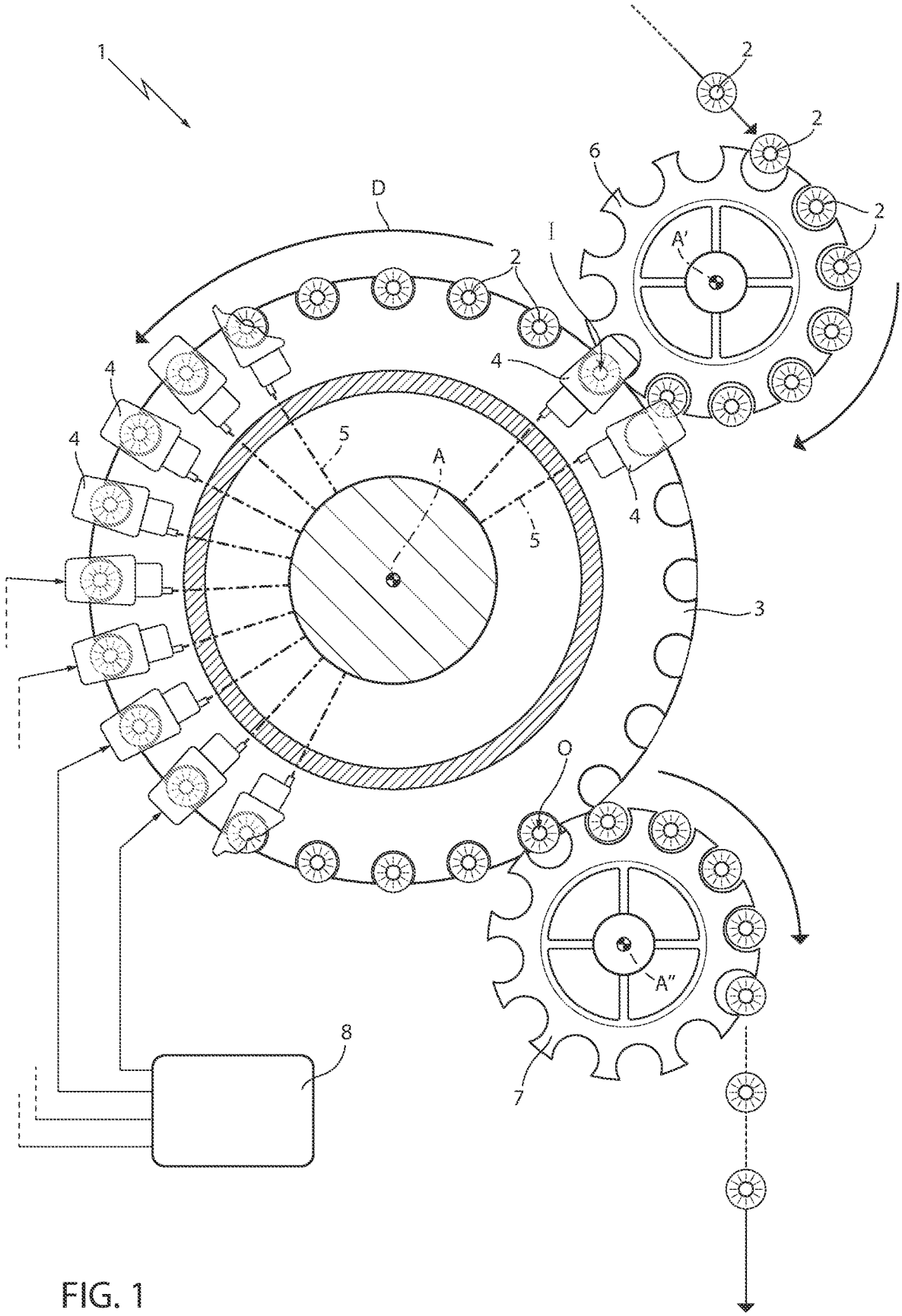
FIG. 1 is a schematic top view, with parts removed for clarity, of a filling machine according to the present invention.

The filling machine 1 is configured for filling containers 2 with a pourable product.

The containers 2 can be bottles, made of plastic or glass, cans, jars, pots, or the like. The pourable product can be for example a pourable food product such as water, wine, juice, yogurt, honey, milk, beer, soft drinks, vegetables to be canned, powders like sugar, coffee or salt, or the like.

The filling machine 1 comprises a conveyor 3. The machine 1 is configured so that the conveyor 3 receives sequentially the containers 2 to be filled at an input station I thereof. The machine 1 is configured so that the conveyor 3 advances sequentially the received containers 2 along a filling path. The machine 1 is configured so that the conveyor 3 releases sequentially the filled containers 2 at an output station O thereof.

The machine 1 comprises a plurality of filling devices 4. The filling devices 4 are carried by the conveyor 3. Each filling device 4 comprises a respective filling valve. Each filling device 4 is configured for delivering the product to at least one container 2 to be filled at a time. Said delivering is carried out during the advancement of the at least one container to be filled along the filling path and by means of the respective filling valve being in an open position. For each filling device, the filling valve is controllable between the respective open position and a respective closed position. Each filling device 4 can be configured for a contact filling, which means that the filling device 4 is configured so that the delivering can be carried out by contact between the filling valve and the at least one container to be filled. Each filling device 4 can be, alternatively or in addition, configured for a contactless filling, which means that the filling device 4 is configured so that the delivering can be carried out without contact between the filling valve and the at least one container to be filled.

The conveyor 3 is configured for being cyclically subjected to a closed movement. The machine 1 is configured so that, for each filling device 4, each repetition of the closed movement of the conveyor corresponds to a filling cycle. For each filling device 4, each filling cycle corresponds to the filling of a respective at least one container 2 by means of the filling device 4.

From now on, "cyclically" means "for each repetition of the closed movement of the conveyor" and/or "for each filling cycle".

The conveyor 3 comprises a carousel rotatable about a longitudinal axis A. The filling devices 4 are carried by the carousel and are angularly distributed around the longitudinal axis A.

For each filling device 4, each filling cycle corresponds to a lap or round of the carousel 3.

As visible in FIG. 1, filling machine 1 further comprises an inlet conveyor, preferably a first star wheel 6, adapted to feed a succession of empty containers 2 to carousel 3 at the input station I, and an outlet conveyor, preferably a second star wheel 7, adapted to receive filled containers 2 from carousel 3 at output station O.

In particular, first star wheel 6 and second star wheel 7 are rotatable around respective rotation axes A' and A", substantially parallel to axis A.

In light of the above, input station I and output station O define two angular positions at which each filling device 4 passes cyclically, due to the rotation of carousel 3 about axis A.

The input station I and the output station O are angularly spaced from one another and delimit a filling angle, relative to said longitudinal axis A, along which the containers 2 are fillable by respective filling devices 4.

The machine 1 is configured so that, for each filling device 4, the filling device 4 receives cyclically at least one container 2 to be filled at a time, when the filling device 4 is at the input station I.

Accordingly, carousel 3 and first inlet star wheel 6 are synchronized in rotation about the respective axes A, A' so that the above condition is respected for each filling cycle.

Filling machine 1 further comprises a control unit 8. The machine 1 is configured so that the control unit 8 controls the conveniently synchronous rotation of carousel 3, first star wheel 6 and second star wheel 7 about axes A, A', A" respectively. The filling machine is configured so that the control unit 8 controls the filling valve of each filling device 4 between the respective open position and the respective closed position.

The machine 1 is configured so that, for each filling device 4, the control unit 8 cyclically sends, with an advance time before the filling device 4 receives the at least one container, an opening control signal for triggering the opening of the respective filling valve. The opening means the passage of the filling valve from the closed position to the open position.

Correspondingly, the machine 1 is configured so that, for each filling device 4, the filling device 4 cyclically receives the respective opening control signal with said advance time.

It is known in the industry that the filling valves operate with an intrinsic delay due to the unavoidable inertia of the mechanical components thereof. Furthermore, a part of such delay is also due to the power for controlling of such valves, for example pneumatic power in the case of pneumatic valves.

These effects can lead, especially after long usage, to a relatively long opening transient of the filling valves. This can result in product spillage, especially in non-contact filling valves, and in a reduction of the actual filling angle, which can have undesired effects on the expected production volume.

In the filling machine 1, the filling angle can be better exploited thanks to the advance time compensating the transient of each filling valve. In fact, the advance time can cover at least a part of the time delay between the instant of sending the opening signal and the instant on which the product starts to be fed or delivered by the filling valve.

The opening signal travels at the speed of light and are received almost instantly when sent.

In fact, between the moment in which control unit 8 sends the opening signal and the effective moment in which the pourable product flows out of the filling valve of the respective filling device 4 and into the container 2, filling device 4 has already completed a certain angle due to the above-mentioned intrinsic delay, i.e. the transient opening angle.

Thanks to the advance time, the transient opening angle of the filling valve can be regained and the nominal filling angle can be maintained.

By controlling the opening of the filling valve in advance, i.e. with an advance time relative to the moment filling device 4 passes at input station I for receiving the container 2, such transient opening angle is regained, i.e. recovered.

Thus, the nominal filling angle can be preserved and fully exploited for filling, without losing any portion of such angle due to valve opening delay.

This is particularly useful for adapting filling machine 1 to containers 2 of different formats, i.e. containers 2 adapted to receive different amounts of pourable product.

In fact, upon an increase in the format, the advance time can be used to avoid having to increase the nominal filling angle. This increase of the nominal filling angle, at constant production speed, would have required the replacement of the carousel 3 with a bigger one.

The filling devices 4 are angularly equally spaced around said longitudinal axis A with an angular pitch.

The increase of the format, would have required, at constant production speed, alternatively to the increase of the filling angle and therefore to the replacement of the carousel 3, a decrease of the pitch.

The filling machine 1 is configured therefore for carrying out a filling method which allows the user to avoid having to make strong structural modifications upon occurring of a certain increase of the format at constant production speed.

Therefore, a filling machine configured for performing a more efficient and/or more flexible filling method is provided.

The machine 1 is configured so that, for each filling device 4, the respective opening control signal is cyclically sent by the control unit 8 and/or cyclically received by the filling device 4, when the filling device 4 is at a predetermined angular position P1 upstream of the input station I, relative to the direction of rotation of the carousel 3 about said longitudinal axis A.

Figure 2:
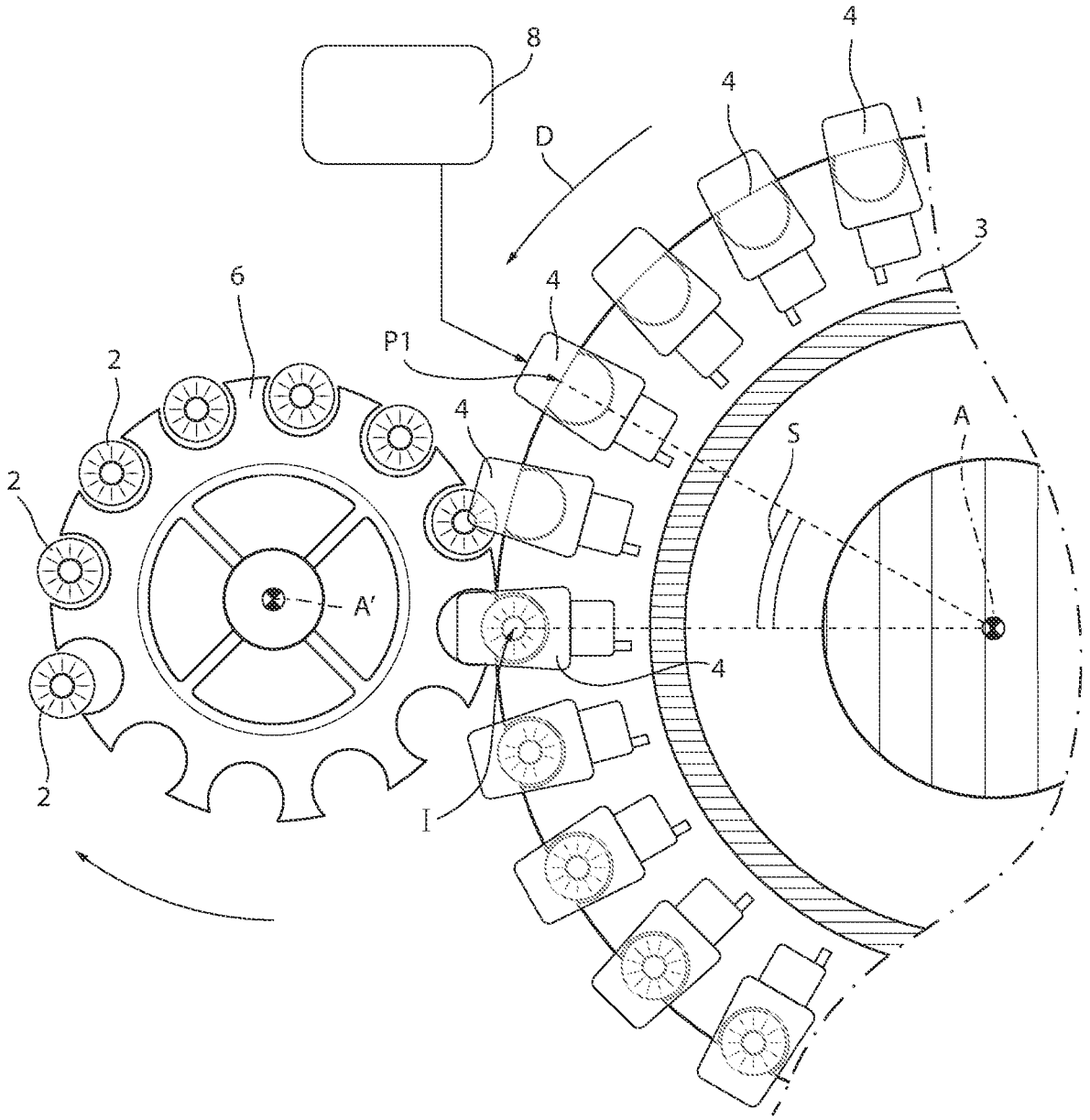
FIG. 2 is a larger-scale schematic top view, with parts removed for clarity, of a detail of the filling machine of FIG. 1 during a first operative condition.
Figure 3A:
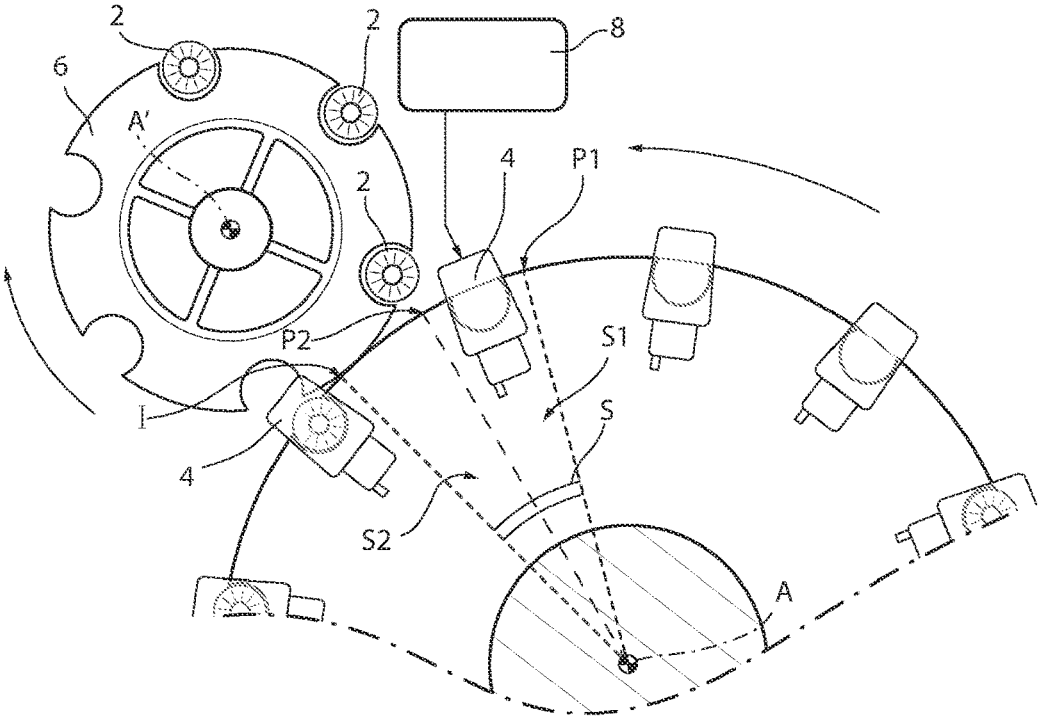
FIGS. 3*a* and 3*b* are larger-scale schematic top view, with parts removed for clarity, of a detail of the filling machine of FIG. 1 during two further distinct operative conditions.
Figure 3B:
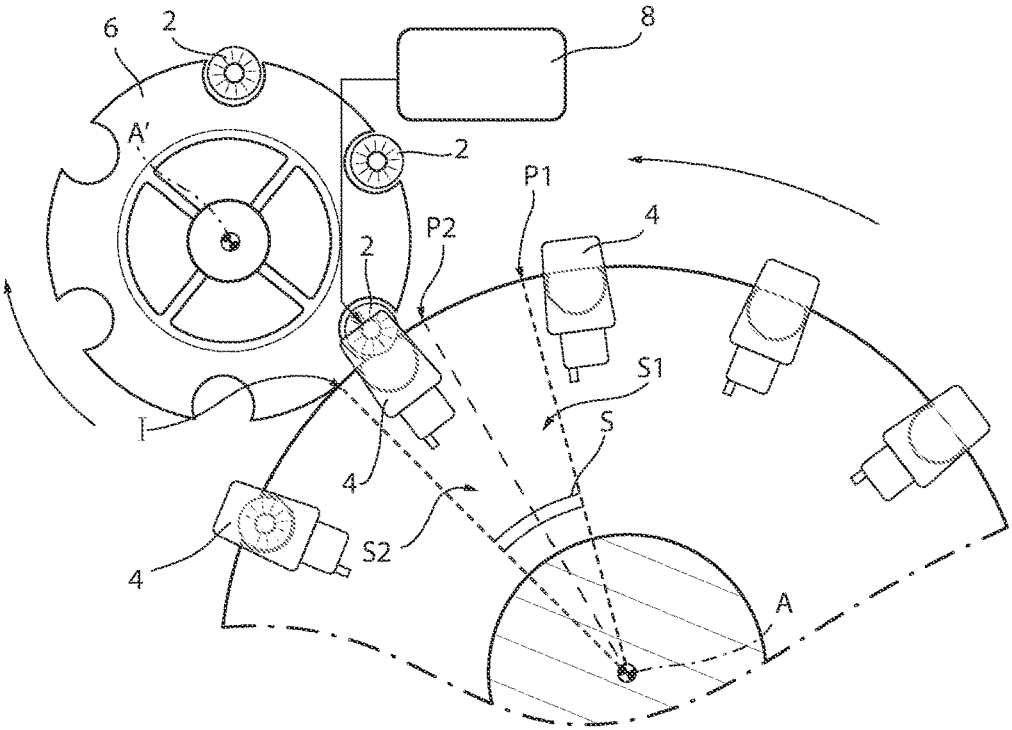

The predetermined angular position P1 is angularly spaced from the input station I by an advance angular sector S. The advance angular sector S is positioned upstream of and adjacent to the filling angle, relative to said direction of rotation. The predetermined position P1 and the angular sector S are indicated in FIGS. 2, 3A and 3B.

The angular sector S corresponds to the advance time. The machine 1 is configured so that the advance time is the time cyclically elapsing between the moment each respective filling device 4 receives the opening control signal from the control unit 8 and the moment the same filling device 4 receives one respective container 2 to be filled at the input station I.

The machine 1 is configured for allowing a user to set an angular extension of said angular sector S.

The machine 1 is configured for allowing a user to set said angular extension by indicating a number of steps of said angular pitch corresponding to the desired angular extension.

In this way, the angular pitch of filling devices 4 on carousel 3 can be used to set sector S. This is particularly advantageous since the angular pitch is a quantity widely used in the field to set other adjustable parameters of filling machines of the above type. Thus, machine 1 is configured for simplifying the adjustment of angular extension of sector S by a user. Therefore the adjustment of the machine 1 to the container format is more simple.

For example, the angular extension of sector S can be set to be equal to n steps of the angular pitch, wherein n is for example an integer number or a decimal number.

For example, the angular extension of sector S can be set to be equal to 4 steps.

In light of the above, since input station I is fixed and does not vary, because it is at an angular position defined by the place at which first star wheel 6 feeds containers 2 to carousel 3, the angular extension of sector S is varied by varying the angular position of position P1.

The angular sector S comprises a first angular portion S1 and a second angular portion S2 which is downstream of the first angular portion S1 and upstream of the input station I, relative to said direction of rotation.

In greater detail, first portion S1 angularly extends from first predetermined position P1 to a second predetermined position P2 arranged between first predetermined position P1 and input station I. For example, second predetermined position P2 is arranged in the middle between first predetermined position P1 and input station I.

Accordingly, second portion S2 angularly extends from second predetermined position P2 to input station I.

The first angular portion S1 and the second angular portion S2 are indicated in FIGS. 3A and 3B.

The machine 1 is configured so that, if a predetermined condition occurs, the control unit 8 sends to the carousel a braking control signal for triggering a change in rotational velocity of the carousel 3.

The machine 1 is configured so that, for each filling device 4, the control unit 8 can send a closing control signal to the filling device 4 for triggering the closing of the filling valve.

The machine 1 is configured so that, when the control unit 8 sends the braking control signal to the carousel 3, the control unit 8 sends the closing control signal to each filling device 4 being within the first angular portion S1 and downstream of said first predetermined angular position P1.

Therefore, the machine 1 is configured so that, for each filling device 4 being within the first portion S1 when the braking signal is sent, the control unit 8 sends the respective closing control signal to the filling device 4.

For example, in the event that a system failure occurs which requires control unit 8 to send the braking control signal to carousel 3 while one filling device 4 is travelling along first portion S1, i.e. when control unit 8 has sent the opening control signal to the above filling device 4 at P1 and such filling device 4 has already received the opening control signal at P1 (or slightly after P1), then control unit 8 sends (preferably immediately) the closing control signal to such filling device 4 travelling along first portion S1.

In this way, it is possible to avoid product spills from the filling valves in the event of sudden change (reduction) of rotational velocity of carousel 3, even if the filling valves are controlled to be opened before the relative filling devices 4 have received the respective containers 2 at input station I.

The machine 1 is configured so that, for each filling device 4 having received the closing control signal within the first angular portion S1, the control unit 8 sends the opening control signal to the filling device 4 when the filling device is at the input station I.

Hence, for the particular filling devices 4 within the first angular portion S1, the transient angle is not regained, but the filling process is carried out indeed and undesired product spillage is avoided.

This is particularly advantageous in the case the filling devices 4 are configured at least for a contactless filling and are used for a contactless delivering of the product to the at least one container to be filled.

The machine 1 is configured so that, when the control unit 8 sends, in use, the braking control signal to the carousel 3, the control unit 8 does not send the closing control signal to each filling device 4 being within the second angular portion S2 and downstream of said predetermined angular position P1.

Therefore, the machine 1 is configured so that, for each filling device 4 being within the second portion S2 when the braking signal is sent, the control unit 8 does not send the respective closing control signal to the filling device 4. In this way for the filling devices 4 which are closer to the input station I and for which the risk of spillage of a significant amount of product is lower, the transient angle is regained.

The machine 1 is configured so that, for each filling device 4, the control unit 8 performs a respective operative sequence for each at least one container to be filled which is received by the filling device 4.

The operative sequence comprises measuring an amount of pourable product actually delivered to the at least one container 2.

The operative sequence comprises comparing the measured amount with a nominal amount of pourable product.

The operative sequence comprises calculating a difference between the measured amount and the nominal amount.

The operative sequence comprises updating the respective advance time based on the calculated difference.

In other words, the advance time, i.e. the angular extension of sector S, is constantly updated for each filling device 4 based on the actual amount of pourable product delivered by the filling device 4.

In this way, the filling operations carried out sequentially by each filling device 4 on subsequent containers 2 are progressively adaptable to the actual operative conditions of the specific filling device 4, in terms of temperature, wear and other conditions of the components, or other parameters which can cause a variation in the performance of the filling device 4.

The filling method comprises the above phases and/or steps.

The advantages of filling machine 1 and of the method for filling containers 2 according to the present invention will be clear from the foregoing description.

In particular, thanks to the above configuration, the transient opening angle of each filling valve can be regained and the nominal filling angle can be maintained. Thus, the nominal filling angle can be preserved and fully exploited.

Furthermore, it is possible to avoid product spills from the filling valves in the event of sudden change of rotational velocity of carousel 3, even if the filling valves are controlled to be opened before the relative filling devices 4 have received the respective container 2 at input station I. This is particularly advantageous for filling valves of non-contact type.

Moreover, the filling process is adaptable to the actual operative conditions of filling devices 4, in terms of temperature, wear of the components, production speed, density of the pourable product, or other parameters which can cause a variation in the performance of filling devices 4 during the filling process.

Clearly, changes may be made to filling machine 1 or filling method as described herein without, however, departing from the scope of protection as defined in the accompanying claims.

The invention claimed is:

1. A filling machine (1) configured to fill containers (2) with a pourable product, comprising:

a conveyor (3), the machine (1) being configured so that the conveyor sequentially receives containers (2) to be filled at an input station (I) thereof, sequentially advances the received containers (2) along a filling path, and sequentially releases the filled containers (2) at an output station (O) thereof;

a plurality of filling devices (4) carried by the conveyor (3), each filling device (4) comprising a respective filling valve and being configured for delivering the product to at least one container (2) to be filled at a time, during the advancement of at least one container to be filled along the filling path and by means of the respective filling valve being in an open position, the filling valve of each filling device being controllable between the respective open position and a respective closed position;

a control unit (8);

wherein the machine (1) is configured so that, for each filling device (4):

the filling device (4) receives cyclically at least one container (2) to be filled, when the filling device (4) is at the input station I;

with an advance time before the filling device (4) receives the at least one container to be filled, the control unit (8) cyclically sends an opening control signal for triggering the opening of the respective filling valve.

2. The filling machine as claimed in claim 1, wherein the machine (1) is configured so that, for each filling device (4), the control unit (8) cyclically sends the respective opening control signal to the filling device (4) when the filling device (4) itself is at a predetermined position (P1) upstream of the input station (I), relative to an advancement direction of the filling devices (4).

3. The filling machine as claimed in claim 1, wherein the conveyor comprises a carousel (3) rotatable about a longitudinal axis (A), the filling devices (4) being carried by the carousel (3) and being angularly distributed around said longitudinal axis (A);

wherein the input station (I) and the output station (O) are angularly spaced from one another and delimit a filling angle, relative to said longitudinal axis (A), along which the containers (2) are fillable by respective filling devices (4); and wherein the machine is configured so that, for each filling device (4), the control unit (8) cyclically sends the respective opening control signal to the filling device (4) when the filling device (4) is at a predetermined angular position (P1) upstream of the input station (I), relative to the direction of rotation of the carousel (3) about said longitudinal axis (A).

4. The filling machine as claimed in claim 3, wherein said predetermined angular position (P1) is angularly spaced from the input station (I) by an advance angular sector (S) positioned upstream of and adjacent to the filling angle, relative to said direction of rotation.

5. The filling machine as claimed in claim 4, wherein the angular sector (S) corresponds to said advance time, the machine (1) being configured so that the advance time is the time cyclically elapsing between the moment each respective filling device (4) receives the opening control signal from the control unit (8) and the moment the same filling device (4) receives at least one container (2) to be filled at the input station (I).

6. The filling machine as claimed in claim 4, wherein said angular sector (S) comprises a first angular portion (S1) and a second angular portion (S2) which is downstream of the first angular portion (S1) and upstream of the input station (I), relative to said direction of rotation;

wherein the machine is configured so that:

if a predetermined condition occurs, the control unit (8) sends a braking control signal for triggering a change in rotational velocity of the carousel (3); and for each filling device (4), the control unit (8) can send a closing control signal to the filling device (4) for triggering the closing of the respective filling valve; and wherein the machine (1) is configured so that: when the control unit (8) sends the braking control signal to the carousel (3), the control unit (8) sends the closing control signal to each filling device (4) being within the first angular portion (S1) and downstream of said predetermined angular position (P1);

when the control unit (8) sends the braking control signal to the carousel (3), the control unit (8) does not send the closing control signal to each filling device (4) being within the second angular portion (S2).

7. The filling machine as claimed in claim 6, wherein the machine (1) is configured so that, for each filling device (4) having received the closing control signal within the first angular portion (S1), the control unit (8) sends the opening control signal to the filling device (4) when the filling device is at the input station (I).

8. The filling machine as claimed in claim 4, wherein the machine (1) is configured for allowing a user to set an angular extension of said angular sector (S).

9. The filling machine as claimed in claim 8, wherein the filling devices (4) are angularly equally spaced around said longitudinal axis (A) with an angular pitch; and wherein the machine (1) is configured for allowing a user to set said angular extension by indicating a number of steps of said angular pitch corresponding to the desired angular extension.

10. The filling machine as claimed in claim 1, wherein the machine (1) is configured so that, for each filling device (4), the control unit (8) performs a respective operative sequence for each at least one container to be filled which is received by the filling device (4), the operative sequence comprising:

measuring an amount of pourable product actually delivered to the at least one container (2);

comparing the measured amount with a nominal amount of pourable product;

calculating a difference between the measured amount and the nominal amount;

updating the respective advance time based on the calculated difference.

11. A filling method for filling containers (2) with a pourable product, comprising:

sequentially receiving containers (2) to be filled at an input station (I), sequentially advancing the received containers (2) along a filling path, and sequentially releasing the filled containers (2) at an output station (O);

sequentially carrying a plurality of filling devices (4), each filling device (4) comprising a respective filling valve;

by means of each filling device (4) being carried, delivering the product to at least one container (2) to be filled at a time, said delivering being performed during the advancement of the at least one container to be filled along the filling path and by means of the respective filling valve being in an open position, the filling valve of each filling device being controllable between the respective open position and a respective closed position; and wherein, for each filling device (4), the filling device (4) receives cyclically at least one container (2) to be filled at the input station (I);

with an advance time before the filling device (4) receives the at least one container to be filled, the method comprises cyclically sending an opening control signal to trigger the opening of the respective filling valve.

12. The method as claimed in claim 11, wherein:

the input station (I) and the output station (0) are angularly spaced from one another and delimit a filling angle, around a longitudinal axis (A), along which angle the containers (2) are fillable by respective filling devices (4);

for each filling device (4), the respective opening control signal is cyclically sent when the filling device (4) is at a predetermined angular position (P1) upstream of the input station (I), relative to the direction of rotation of the carousel (3) about said longitudinal axis (A);

said predetermined angular position (P1) being angularly spaced from the input station (I) by an advance angular sector (S) positioned upstream of and adjacent to the filling angle, relative to an advancement direction of the filling devices (4);

wherein the angular sector (S) corresponds to said advance time, the advance time being the time cyclically elapsing between the moment each respective filling device (4) receives the opening control signal from the control unit (8) and the moment the same filling device (4) receives at least one container (2) to be filled at the input station (I).

13. The method as claimed in claim 12, wherein:

said steps of receiving, advancing, releasing, and carrying are carried out by means of a carousel (3) rotating around said axis (A);

said angular sector (S) comprises a first angular portion (S1) and a second angular portion (S2) which is downstream of the first angular portion (S1) and upstream of the input station (I), relative to said direction of rotation;

wherein:

if a predetermined condition occurs, a braking control signal is sent to the carousel (3) for triggering a change in rotational velocity of the carousel (3); and when the braking control signal is sent to the carousel (3), a closing control signal is sent to each filling device (4) being within the first angular portion (S1) and downstream of said predetermined angular position (P1), to trigger the closing of the respective filling vale;

when the braking control signal is sent to the carousel (3), a closing control signal is not sent to each filling device (4) being within the second angular portion (S2).

14. The method as claimed in claim 13, wherein for each filling device (4) having received the closing control signal when being within the first angular portion (S1), the opening control signal is sent to the filling device (4) when the filling device is at the input station (I).

15. The filling method as claimed in claim 11, wherein, for each filling device (4), and for each at least one container to be filled which is received by the filling device (4), the method comprises:

measuring an amount of pourable product actually delivered to the container (2) by the filling device (4);

comparing the measured amount with a nominal amount of pourable product;

calculates a difference between the measured amount and the nominal amount; and updates the respective advance time based on the calculated difference.

16. The filling method as claimed in claim 12, wherein, for each filling device (4), and for each at least one container to be filled which is received by the filling device (4), the method comprises:

measuring an amount of pourable product actually delivered to the container (2) by the filling device (4);

comparing the measured amount with a nominal amount of pourable product;

calculates a difference between the measured amount and the nominal amount; and updates the respective advance time based on the calculated difference.

17. The filling method as claimed in claim 13, wherein, for each filling device (4), and for each at least one container to be filled which is received by the filling device (4), the method comprises:

measuring an amount of pourable product actually delivered to the container (2) by the filling device (4);

comparing the measured amount with a nominal amount of pourable product;

calculates a difference between the measured amount and the nominal amount; and updates the respective advance time based on the calculated difference.

18. The filling method as claimed in claim 14, wherein, for each filling device (4), and for each at least one container to be filled which is received by the filling device (4), the method comprises:

measuring an amount of pourable product actually delivered to the container (2) by the filling device (4);

comparing the measured amount with a nominal amount of pourable product;

calculates a difference between the measured amount and the nominal amount; and updates the respective advance time based on the calculated difference.

* * * * *